US005234628A

United States Patent [19]

Trabitzsch et al.

[11] Patent Number: 5,234,628

[45] Date of Patent: Aug. 10, 1993

[54] PASTE-FORM, LOW-FOAMING NON-PHOSPHATE DETERGENT

[75] Inventors: Uwe Trabitzsch, Ratingen-Homberg; Guenther Amberg, Neuss, both of Fed. Rep. of Germany

[73] Assignee: Henkel Kommanditgesellschaft auf Aktien, Duesseldorf, Fed. Rep. of Germany

[21] Appl. No.: 688,508

[22] PCT Filed: Nov. 15, 1989

[86] PCT No.: PCT/EP89/01371

§ 371 Date: May 24, 1991

§ 102(e) Date: May 24, 1991

[87] PCT Pub. No.: WO90/05773

PCT Pub. Date: May 31, 1990

[30] Foreign Application Priority Data

Nov. 24, 1988 [DE] Fed. Rep. of Germany ..... 3839602

[51] Int. Cl.[5] ..... C11D 3/065

[52] U.S. Cl. ..... 252/540

[58] Field of Search ..... 252/540

[56] References Cited

U.S. PATENT DOCUMENTS 4,832,863 5/1989 Trabitzsch et al. ..... 252/540

4,929,380 5/1990 Schulz et al. ..... 252/540

4,965,014 10/1990 Jeschke et al. ..... 252/540

*Primary Examiner*—Wayne Langel

*Assistant Examiner*—Stuart L. Hendrickson

*Attorney, Agent, or Firm*—Ernest G. Szoke; Wayne C. Jaeschke; Real J. Grandmaison

[57] ABSTRACT

A paste-form, non-phosphate detergent which is particularly suitable for the washing of heavily soiled working apparel and which generates no troublesome foam essentially contains (A) 1 to 3% by weight sodium alkyl benzene sulfonate having linear $C_{9-13}$ alkyl chains, (B) 14 to 18% by weight of a linear or 2-methyl-branched, saturated, primary $C_{12-15}$ alcohol containing 2 to 4 ethylene glycol ether groups, (C) 12 to 16% by weight of a linear or 2-methyl-branched, saturated, primary $C_{12-15}$ alcohol containing 6 to 8 ethylene glycol ether groups, (D) 50 to 65% by weight sodium silicate having the composition $Na_2O:SiO_2=1:0.8$ to 1:1.5, (E) 2 to 8% by weight, based on sodium salt, of at least one complexing agent from the group consisting of nitrilotriacetic acid and polyphosphonic acids, (F) 0.5 to 2.5% by weight water-soluble polymers having a redeposition-inhibiting effect, (G) 0 to 5% by weight other nonsurfactant and non-builder detergent constituents and (H) less than 4% by weight water. The paste can be introduced into washing machines by automatic dispensing systems.

14 Claims, No Drawings

PASTE-FORM, LOW-FOAMING NON-PHOSPHATE DETERGENT

This invention relates to a paste-form, non-phosphate detergent which is particularly suitable for the washing of working apparel that has been heavily soiled, for example with mineral oil, and which does not generate troublesome quantities of foam when used in automatic washing machines. The detergent according to the invention is intended to foam only slightly both in the main wash cycle and in the rinse cycle, even under particularly critical conditions, i.e. even where softened water is used, as is normally the case in institutional laundries, so that no malfunctions occur in the automatic machines used in such laundries.

Paste-form detergents, particularly those having a high content of strongly alkaline constituents, such as sodium metasilicate or soda, have the advantage over powder-form detergents that they can be handled and dispensed with no dust emission. They are particularly suitable for automatic dispensing systems. Their problem is that they have to be sufficiently flowable in a relatively wide temperature range, which seriously restricts freedom of formulation, particularly where it is intended to incorporate large amounts of solid active substances in the paste. Another requirement which paste-form detergents have to satisfy is that they should not separate in storage. A further requirement is that no solvents or suspension stabilizers should be used because they do not contribute to the performance of the detergent.

The present invention, by which this problem is solved, relates to a paste-form, non-phosphate detergent which is characterized in that it contains the following constituents:

A) 1 to 3% by weight sodium alkyl benzene sulfonate having linear $C_{9-13}$ alkyl chains, B) 14 to 18% by weight of a linear or 2-methyl-branched, saturated, primary $C_{12-15}$ alcohol containing 2 to 4 ethylene glycol ether groups, C) 12 to 16% by weight of a linear or 2-methyl-branched, saturated, primary $C_{12-15}$ alcohol containing 6 to 8 ethylene glycol ether groups, D) 50 to 65% by weight sodium silicate having the composition $Na_2O$: $SiO_2$=1:0.8 to 1:1.5, E) 2 to 8% by weight, based on sodium salt, of at least one complexing agent from the group consisting of nitrilotriacetic acid and polyphosphonic acids, F) 0.5 to 2.5% by weight water-soluble polymers having a redeposition-inhibiting effect, G) 0 to 5% by weight of other non-surfactant and non-builder detergent constituents, H) less than 4% by weight water.

The detergent preferably has the following composition:

1.5 to 2.5% constituent A
15.0 to 17.0% constituent B
13.0 to 15.0% constituent C
55.0 to 63.0% constituent D
3.0 to 6.0% constituent E
0.7 to 2.0% constituent F
0.1 to 2.5% constituent G
less than 3% constituent H Constituent (A) consists of an alkyl benzene sulfonate which contains 10 to 13 C atoms in the linear alkyl chain and which is normally called dodecyl benzene sulfonate.

Constituent (B) contains 12 to 15 C atoms in the alcohol radical and may be derived from native or synthetic alcohols (oxoalcohols). Oxoalcohols typically consist of a mixture of linear and 2-methyl-branched alcohols, the linear component being intended to prediminate.

Constituent (C) is derived from the same alcohol or alcohol mixtures as constituent (B). In the interests of low foaming, the $C_{12}$ alcohol component preferably makes up no more than 50% by weight of the alcohol radicals of components (B) and (C), the detergent containing in all no more than 2% by weight and, more especially, less than 1% by weight ethoxylated $C_{16-18}$ alcohols.

Component (D) consists of sodium silicate in which the ratio of $Na_2O$ to $SiO_2$ is from 1:0.8 to 1:1.5 and preferably from 1:0.9 to 1:1.1. The sodium silicate is used in the form of the anhydrous salt.

Constituent (F) is a nonionic or anionic polymer having a redeposition-inhibiting effect. Particularly suitable polymers of this type are cellulose ethers, such as Na carboxymethyl cellulose and mixtures thereof with other cellulose ethers, such as methyl cellulose, ethyl cellulose, hydroxyethyl cellulose, hydroxypropyl cellulose, or mixed ethers, such as methyl hydroxyethyl cellulose, methyl carboxymethyl cellulose or ethyl hydroxyethyl cellulose. Other suitable polymers are polyacrylic acid, copolymers of acrylic acid and vinyl ethers, copolymers of acrylic acid and vinyl ethers, copolymers of acrylic acid and maleic acid (Sokalan ®) in the form of the sodium salts and other known copolymers of acrylic acid with copolymerizable olefinic compounds. Cellulose ethers and synthetic polymers may also be used in combination. Mixtures of carboxymethyl cellulose with methyl cellulose or methyl hydroxyethyl cellulose have proved to be particularly useful.

Component (E) consists of at least one complexing agent from the group consisting of nitrilotriacetic acid (NTA) and polyphosphonic acids in the form of the sodium salt, such as ethylenediamine tetramethylene phosphonic acid (EDTMP), diethylenetriamine pentamethylene phosphonic acid (DTPMP), aminotrimethylene phosphonic acid (ADTMP) and, in particular, 1-hydroxyethane-1,1-diphosphonic acid (HEDP). The detergent preferably contains 3 to 6% by weight NTA (Na salt) and 0.5 to 2% by weight HEDP (Na salt).

The other non-surfactant or non-builder constituents (G) include enzymes, fragrances and typical optical brighteners, more especially optical brighteners showing substantivity to cellulose fibers (cotton) in quantities of 0.05 to 0.5% by weight.

The water content of the detergents should be minimal because free water increases the viscosity of the detergents and, hence, complicates processing and dispensing thereof. Water contents of 2% by weight or less are therefore particularly preferred.

The detergents are prepared by mixing and homogenizing the solid, finely divided constituents with the liquid nonionic surfactants (components B and C). It has surprisingly been found that even the solid alkyl benzene sulfonates, to a level of about half their content, behave like liquid constituents and thus promote the incorporation of high solids percentages. The mixture is then best ground, for example in a colloid mill or on a roll stand, so that the particle size of the suspended solids is from 5 to 80 μm and preferably from 10 to 50 μm. The coarse particle component (larger than 80 μm in size) should preferably be less than 10% by weight.

The detergents are generally used in a concentration of 5 to 12 g/l and preferably in a concentration of 8 to 10 g/l, softened water, i.e. water softened to a hardness of less than 2° Gh and, more particularly, to a hardness of less than 1° Gh, best being used to prepare the wash liquor.

EXAMPLES

A detergent having the following composition was tested. The nonionic surfactants B and C are derived from $C_{12-15}$ oxoalcohols. EO stands for added ethylene oxide. Component (F) consisted of a 2:1 mixture of Na carboxymethyl cellulose and methyl hydroxyethyl cellulose (hydroxyyethyl content 0.8% by weight). The Na salt of 4,4'-bis-(2-anilino-4-morpholino-1,3,5-triazin-6-ylamino)stilbene-2,2'-disulfonic acid was used as the optical brightener. The water emanated from the moisture content of the starting materials used.

The percentages shown are based on % by weight anhydrous substance.

| | Constituent | % by weight |
|---|---|---|
| A | Na dodecyl benzene sulfonate | 2.3 |
| B | $C_{12-15}$ alcohol + 3 EO | 16.0 |
| C | $C_{12-15}$ alcohol + 7 EO | 14.0 |
| D | $Na_2O:SiO_2$ = 1:1 | 59.2 |
| $E_1$ | NTA (trisodium salt) | 4.4 |
| $E_1$ | HEDP (tetrasodium salt) | 1.2 |
| F | cellulose ether | 1.0 |
| G | optical brightener | 0.1 |
| H | water | 1.8 |

The mixture is ground for 30 minutes in a mill (colloid mill). The ground product has a temperature of approximately 45° C. and an average particle size of the solids of 30 μm. The viscosity (Brookfield) was 15 Pa.s at 20° C.

A powder-form detergent according to DE 36 44 808 Al (Example 1) was used for comparison.

Washing conditions

Front-loading automatic washing machine (model FRISTA®); detergent concentration 10 g/l; charging ratio 1:14.5; ratio of kg laundry to liter wash liquor 1:5; water hardness 1° Gh; prewash 20 minutes at 70° C.; main wash 10 minutes at 50° to 60° C.; three rinses; twice with softened water, final rinse with tapwater. Crease-resistant cotton ($C_{cr}$) soiled with used engine oil (mineral oil) was used as the fabric.

The results of the washing tests and foam measurements (foam height in cm foam column above the liquid level during the first and second wash cycle and in the third rinse cycle) are shown in Table I. Although the comparison product shows slightly more favorable foaming behavior, it is surpassed by the detergent according to the invention in its detergency performance. Basically, the minimal foaming is not a problem, even in the case of the detergent according to the invention. The fact that the detergent can be automatically dispensed from a paste storage container is another advantage.

TABLE I

| | % Remission | Foam height 1st | 2nd | 3rd |
|---|---|---|---|---|
| Example | 78.5 | 25 | 50 | 10 |
| Comparison | 76.7 | 20 | 40 | 0–10 |

We claim:

1. A paste-form, non-phosphate detergent composition consisting essentially of:
   A) about 1 to about 3% by weight sodium alkyl benzene sulfonate having a linear $C_{9-13}$ alkyl chain;
   B) about 14 to about 18% by weight of a linear or 2-methyl-branched, saturated, primary $C_{12-15}$ alcohol containing about 2 to about 4 moles of ethylene oxide;
   C) about 12 to about 16% by weight of a linear or 2-methyl-branched, saturated, primary $C_{12-15}$ alcohol containing about 6 to about 8 moles of ethylene oxide;
   D) about 50 to about 65% by weight sodium silicate having the composition $Na_2O:SiO_2$=1:0.8 to 1:1.5;
   E) about 2 to about 8% by weight, based on sodium salt, of at least one complexing agent selected from the group consisting of nitrilotriacetic acid and polyphosphonic acid;
   F) about 0.5 to about 2.5% by weight of a water-soluble polymer having a soil redeposition-inhibiting effect;
   G) 0 to about 5% by weight of other non-surfactant and non-builder detergent constituents; and
   H) less than about 4% by weight water, all weights being based on the weight of said composition.

2. A detergent composition as in claim 1 containing: from about 1.5 to about 2.5% by weight of component A; from about 15 to about 17% by weight of component B; from about 13 to about 15% by weight of component C; from about 55 to about 63% by weight of component D; from about 3 to about 6% by weight of component E; from about 0.7 to about 2% by weight of component F; from about 0.1 to about 2.5% by weight of component G; and less than about 3% by weight of component H.

3. A detergent composition as in claim 1 containing from about 3 to about 6% by weight of nitrilotriacetic acid, based on the sodium salt.

4. A detergent composition as in claim 1 wherein ingredient E comprises from about 0.5 to about 2% by weight of 1-hydroxyethane -1, 1-diphosphonic acid, based on the sodium salt.

5. A detergent composition as in claim 8 where ingredient G comprises from about 0.05 to about 0.5% by weight of an optical brightener.

6. A detergent composition as in claim 1 free from an organic solvent and a dispersion stabilizer.

7. A detergent composition as in claim 1 wherein said component F is selected from the group consisting of a cellulose ether, a polymer or copolymer of acrylic acid, and mixtures thereof.

8. A detergent composition as in claim 1 wherein said polyphosphonic acid is selected from ethylenediamine tetramethylene phosphonic acid, diethylenetriamine pentamethylene phosphonic acid, aminotrimethylene phosphonic acid, and 1-hydroxyethane-1, 1-diphosphonic acid.

9. A detergent composition as in claim 1 wherein said component G is selected from an enzyme, a fragrance, and an optical brightener.

10. The process of preparing a past-form, non-phosphate detergent composition comprising;
   (1) preparing a mixture consisting essentially of
      A) about 1 to about 3% by weight sodium alkyl benzene sulfonate having a linear $C_{9-13}$ alkyl chain;

B) about 14 to about 18% by weight of a linear or 2-methyl-branched, saturated, primary $C_{12-15}$ alcohol containing about 2 to about 4 moles of ethylene oxide;

C) about 12 to about 16% by weight of a linear or 2-methyl-branched, saturated, primary $C_{12-15}$ alcohol containing about 6 to about 8 moles of ethylene oxide;

D) about 50 to about 65% by weight sodium silicate having the composition $Na_2O:SiO_2=1:0.8$ to 1:1.5;

E) about 2 to about 8% by weight, based on sodium salt, of at least one complexing agent selected from the group consisting of nitrilotriacetic acid and polyphosphonic acid;

F) about 0.5 to about 2.5% by weight of a water-soluble polymer having a soil redeposition-inhibiting effect;

G) 0 to about 5% by weight of other non-surfactant and non-builder detergent constituents; and H) less than about 4% by weight water, all weights being based on the weight of said composition; and 2) grinding the mixture so that the particle size of the suspended solids is reduced to from about 5 to about 80 microns and the mixture becomes homogenized.

11. The process as in claim 10 wherein said grinding step is conducted in a colloid mill.

12. The process as in claim 10 wherein said grinding step is conducted on a roll stand.

13. The process as in claim 10 wherein the particle size of the suspended solids is reduced to from about 10 to about 50 microns.

14. The process as in claim 10 wherein the content of suspended solids having a particle size larger than 80 microns is less than about 10% by weight.

* * * * *

UNITED STATES PATENT AND TRADEMARK OFFICE

CERTIFICATE OF CORRECTION

PATENT NO. : 5,234,628

DATED : August 10, 1993

INVENTOR(S) : Trabitzsch et. al.

It is certified that error appears in the above-indentified patent and that said Letters Patent is hereby corrected as shown below:

In claim 5, column 4, line 45, "claim 8", should read:
-- claim 1 --.

Signed and Sealed this

Eighteenth Day of April, 1995

Bruce Lehman

*Attest:*

BRUCE LEHMAN

*Commissioner of Patents and Trademarks*

*Attesting Officer*